United States Patent [19]

Ohlendorf et al.

[11] 4,384,556

[45] May 24, 1983

[54] VALVE SHUT-OFF ARRANGEMENT FOR A MULTICYLINDER INTERNAL COMBUSTION ENGINE

[75] Inventors: Rolf Ohlendorf; Horst Graf, both of Weinstadt, Fed. Rep. of Germany

[73] Assignee: Daimler-Benz Aktiengesellschaft, Stuttgart, Fed. Rep. of Germany

[21] Appl. No.: 264,708

[22] Filed: May 18, 1981

[30] Foreign Application Priority Data

May 16, 1980 [DE] Fed. Rep. of Germany ..... 3018719

[51] Int. Cl.[3] ..... F02D 17/00

[52] U.S. Cl. ..... 123/198 F; 123/90.18

[58] Field of Search ..... 123/90.16, 90.17, 90.18, 123/198 F

[56] References Cited

U.S. PATENT DOCUMENTS 1,350,989 8/1920 Cox ..... 123/198 F
1,399,941 12/1921 Douglas et al. ..... 123/198 F
3,523,465 8/1970 Harrell ..... 123/90.18 X
4,173,209 11/1979 Jordan ..... 123/198 F

FOREIGN PATENT DOCUMENTS 281228 4/1911 Fed. Rep. of Germany .

*Primary Examiner*—Tony M. Argenbright
*Attorney, Agent, or Firm*—Craig & Burns

[57] ABSTRACT

A multicylinder, especially six or eight cylinder internal combustion engine, which includes a valve shut off and a cam shaft on which is arranged a hollow shaft. The hollow shaft includes cams and is non-rotatably supported on the cam shaft. The hollow shaft is adapted to be connected with transmitting elements operating the valves of the respective cylinders which may be shut off. A connection to the transmitting elements between the cams of the hollow shaft and the transmission elements is eliminated by an axial displacement of the hollow shaft.

10 Claims, 2 Drawing Figures

VALVE SHUT-OFF ARRANGEMENT FOR A MULTICYLINDER INTERNAL COMBUSTION ENGINE

Figure 1:
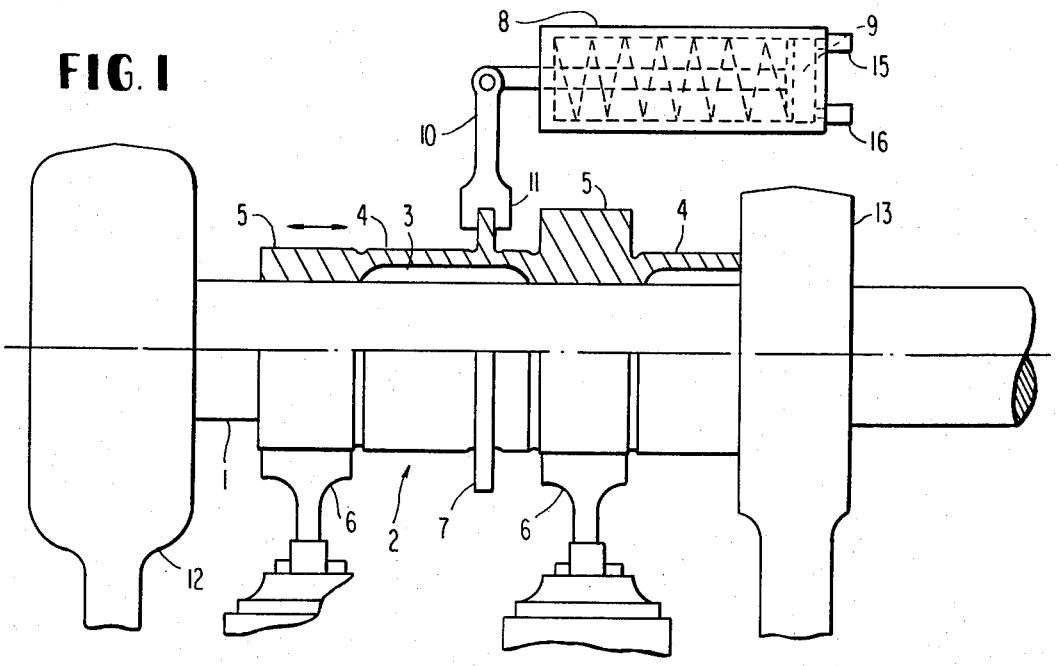

The present invention relates to a multicylinder internal combustion engine and, more particularly, to a six or eight cylinder internal combustion engine provided with a valve shut-off means and with a cam shaft having non-rotatably supported thereon a hollow shaft with cams, which hollow shaft is connected with transmitting elements operating the valves effecting a shut-off action of the engine.

In order to lower a power consumption of high power internal combustion engines with six or eight cylinders under certain operating conditions it has been proposed in, for example, German Patent Application P 29 30 967.9 to interrupt the fuel feed to several cylinders and simultaneously deactivate inlet and outlet valves associated with the cylinders. A disadvantage of this proposed construction resides in the fact that the valve shut-off mechanism employs an expensive planetary transmission arrangement with a brake means, with the planetary transmission and brake means providing a non-rotational or rotational connection between the cams associated with the valves adapted to be shut-off and the cam shaft.

In German Offenlegungsschrift 2,621,794, another valve shut-off arrangement is proposed which is accommodated in a rocker arm bearing, with the rocker arms being actuated by a bottom positioned cam shaft through a push rod. A disadvantage of this proposed construction resides in the fact that because the moving masses are relatively large, such a control arrangement only permits a limited number of revolutions.

In German Patent Application P 28 14 087.6, another valve shut off arrangement is proposed for connecting or disconnecting the valve, with the arrangement being disposed between a swing arm and an end of a valve stem.

A disadvantage of this proposed arrangement resides in the fact that such construction perforce results in an unfavorable structural height of the internal combustion engine.

The aim underlying the present invention essentially resides in providing a valve shut-off arrangement for a multicylinder internal combustion engine by which it is possible to incorporate or retain the existing cam shaft bearing as well as valve operating parts of the engine in an extensively unchanged or unaltered condition.

In accordance with advantageous features of the present invention, the valve shut off arrangement is provided which includes a cam shaft on which a hollow shaft with cams is non-rotatably supported, with the hollow shaft being connected with transmitting elements operating the valves which are to be shut-off. A connection to the transmitting elements is eliminated for the cams by an axial displacement of the hollow shaft.

By virtue of the above-noted features of the present invention, a very simple construction of a mechanical arrangement is arranged and, to effect a valve shut off, the cams arranged on the hollow shaft are merely moved away from the transmitting elements such as, for example, rocker arms, swing arms, or the like, so that they can freely rotate beside the transmitting elements.

In accordance with further features of the present invention, a connection between the cams and the transmitting elements may be eliminated by a hydraulic means connected with the hollow shaft and controllable in dependence upon a load and number of revolutions or rotational speed of the internal combustion engine.

Advantageously, the parts of the hollow shaft arranged beside the cams have a diameter corresponding to that of a cam base circle.

In accordance with further features of the present invention, the hollow shaft is provided with a collar connected with a switching lever of the hydraulic unit.

Accordingly, it is an object of the present invention to provide a valve shut-off arrangement for a multicylinder internal combustion engine which avoids, by simple means, shortcomings and disadvantages encountered in the prior art.

Another object of the present invention resides in providing a valve shut-off arrangement for a multicylinder internal combustion engine which may be installed with a minimum modification of existing valve operating parts of the engine.

A further object of the present invention resides in providing a valve shut-off arrangement for a multicylinder internal combustion engine which functions realiably under all load conditions of the engine.

A still further object of the present invention resides in providing a valve shut-off arrangement for a multicylinder internal combustion engine which is simple in construction and therefore relatively inexpensive to manufacture.

Another object of the present invention resides in providing a valve shut-off arrangement for a multicylinder internal combustion engine which does not adversely effect the structural height of the engine.

Figure 2:
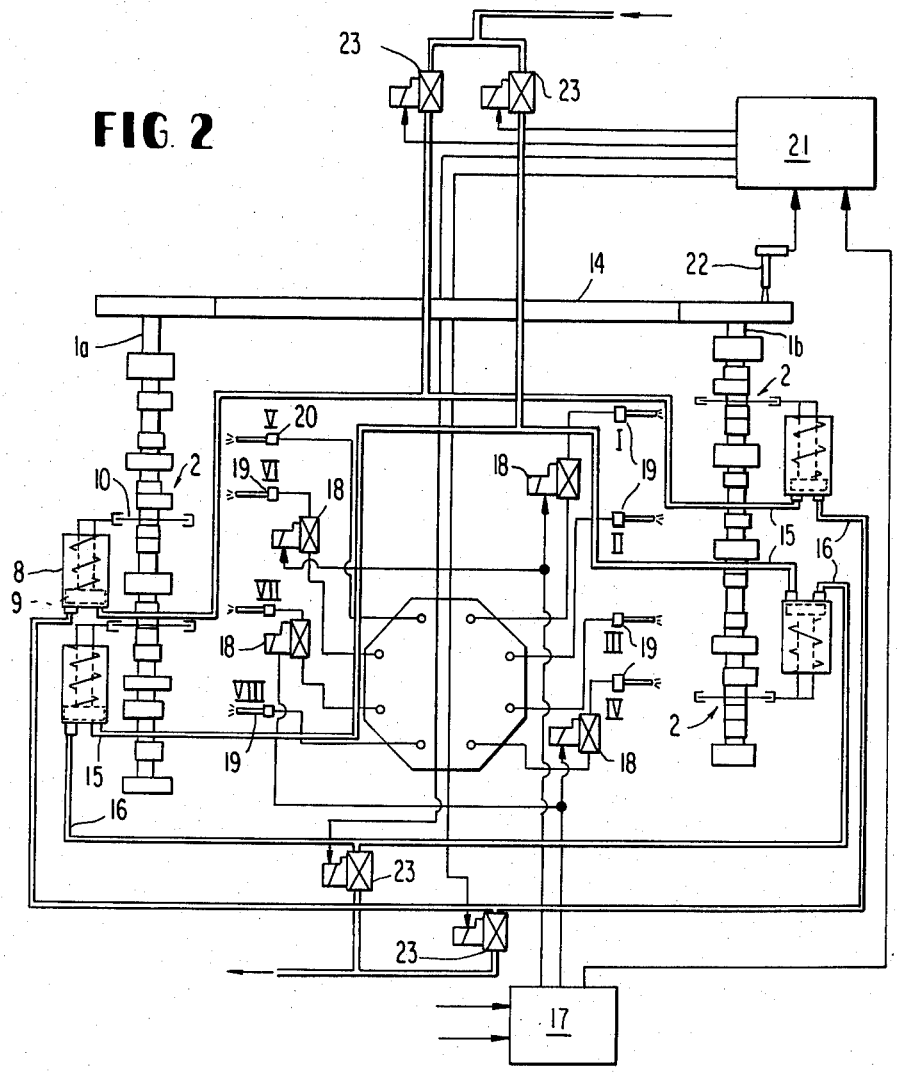

These and other objects, features, and advantages of the present invention will become more apparent from the following description when taken in connection with the accompanying drawing which shows, for the purpose of illustration only, one embodiment in accordance with the present invention, and wherein:

FIG. 1 is a partially schematic longitudinal cross sectional view of a cam shaft arrangement for a multicylinder internal combustion engine with partially illustrated swing arms, for a valve shut-off arrangement of the present invention; and FIG. 2 is a switching control diagram of a valve shut-off arrangement constructed in accordance with the present invention for an eight cylinder internal combustion engine.

Referring now to the drawings wherein like reference numerals are used in both views to designate like parts and, more particularly, to FIG. 1, according to this figure, a cam shaft arrangement includes an inner cam shaft 1 and a quill shaft generally designated by the reference numeral 2 concentrically supported thereon. The hollow shaft 2 is nonrotatably connected with the cam shaft 1 by a suitable fitting key or adapter spring 3 but is guided on the cam shaft 1 for a longitudinal displacement. The hollow shaft 2 includes a cylindrical hollow shaft part 4 and two cams 5 on which are supported transmitting elements 6 constructed as swing levers and associated with the inlet and outlet valves of the respective cylinders, which inlet and outlet valves are adapted to be selectively shut-off.

A collar 7 is provided on the hollow shaft 2, with the collar 7 being adapted to provide an engagement portion for a suitable actuating unit such as, for example, a hydraulic unit 8 which is controllable in dependence upon the rotational speed of the engine and/or the load. The hydraulic unit 8 includes a spring-loaded piston 9 connected to a switching lever 10 having a bifurcated end section 11 extending over the collar 7. In FIG. 1, the hollow shaft 2, displaceable between two cam shaft bearings 12, 13 is illustrated in a position wherein the valves are connected.

In order to shut off the deactivatable valves, the hollow shaft 2 is shifted by the hydraulic unit 8 toward the left of FIG. 1 to such an extent that the cams may fully rotate adjacent the swing arms 6. In the displaced position, the swing arms 6 rest on the cylindrical hollow shaft part 4 and the deactivatable valves are shut off, i.e., they are in a closed position. The activation of the respective valves takes place at a point in time at which the cams 5 contact the swing arms 6 with the base circle.

FIG. 2 provides an example of a switching control arrangement for an eight-cylinder V-type internal combustion engine provided with two cam shafts 1*a* and 1*b* driven by a timing chain 14. Each cam shaft 1*a*, 1*b* is provided with two hollow shafts, with each hollow shaft having two cams respectively associated with one cylinder designated I-VIII. Based on identical ignition interval or spacing, hollow shafts 2 of the cam shaft 1*a* are located interior and the hollow shafts 2 of the cam shaft 1*b* are located exteriorly. The hydraulic unit 8 is provided for controlling a positioning of each of the hollow shafts 2, with appropriate pressure medium lines or conduits 15, 16 being connected to the respective hydraulic devices 8.

As shown in FIG. 2, a control unit, of conventional construction, is provided for controlling the shutting off and reconnecting of the respective cylinders. Engine load and rotational speed sensors (not shown) in addition to possibly further signal transmitters or sensors are provided for supplying input variables to the control device 17. The control device 17 actuates four solenoid-operated valves 18 in a speed and load range of the engine suitable for valve connection or activation. The solenoid operated valves 18 are arranged in fuel lines 20 leading to injection nozzles 19 and are adapted to reinstate or restart a previously interrupted fuel feed for the disconnectible cylinders I, IV, VI, VII.

A second control device 21 is provided for the valve shut-off arrangement, with the second control device 21 receiving a readiness signal for a control device 17. The control device 21, which is in the readiness position, then acts on four solenoid-operated valves 23 after receipt of a further signal from a signal generator responding to a specific cam position. The spring loaded pistons 9 arranged in the hydraulic cylinders of the respective hydraulic units 8 are placed under pressure and the hollow shafts 2 are brought, by way of the bifurcate switching levers 10, into a position wherein the swing arms 6 are again supported on the cams 5 associated with the valves which can be shut off.

Accordingly, the previously disconnected cylinders I, IV, VI, VII, are once again reconnected or activated and an eight cylinder operation of the internal combustion engine is resumed.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A multicylinder internal combustion engine comprising a cam shaft means, and a valve shut off means for selectively connecting and disconnecting valves of at least some of the cylinders, the valve shut off means includes a hollow shaft means non-rotatably supported on the cam shaft means and connected with transmitting means of the valves, means for axially displacing the hollow shaft means of the valve shut off means so as to disconnect the connection between said shaft means and the transmitting means, the hollow shaft means includes a hydraulic means; means for connecting the hydraulic means with the hollow shaft, and means for controlling the hydraulic means in dependence upon at least one of a load and rotational speed of the engine.

2. The multicylinder internal combustion engine according to claim 1, wherein the engine is a six cylinder or eight cylinder engine.

3. The multicylinder internal combustion engine according to claim 1, wherein the hollow shaft includes cam means cooperable with the transmitting means.

4. The multicylinder internal combustion engine according to claims 1 or 3, wherein the hollow shaft includes shaft portions arranged adjacent the cam means, the shaft portions have a diameter corresponding to that of a cam base circle.

5. The multicylinder internal combustion engine according to claim 4, wherein the means for connecting the hydraulic means with the hollow shaft includes a collar portion arranged on the hollow shaft and a switching lever engageable with the collar portion and connected to the hydraulic means.

6. The multicylinder internal combustion engine according to claim 5, wherein the hydraulic means includes a hydraulic cylinder, a spring loaded piston means arranged in the cylinder, and the controlling means includes an electromagnet solenoid valve means for controlling a supply of pressure medium to the hydraulic means.

7. A multicylinder internal combustion engine according to claim 1, wherein the engine is a V-type eight cylinder engine, the cam shaft means includes two cam shafts interconnected by a timing means, the hollow shaft means of the valve shut off means includes a pair of hollow shafts arranged on each of the cam shafts for axial displacement thereon, the means for axially displacing the hollow shaft means includes a hydraulic means provided for each of the hollow shafts, means are provided for connecting the respective hollow shafts with the hydraulic means.

8. The multicylinder internal combustion engine according to claim 7, wherein each of the hollow shafts includes cam means cooperable with the transmitting means.

9. The multicylinder internal combustion engine according to claims 7 or 8, wherein the means for connecting the hydraulic means with the respective hollow shafts includes a collar portion provided on each of the hollow shafts and a switching lever engageable with the respective collar portions and connected to the respective hydraulic means.

10. The multicylinder internal combustion engine according to claim 9, wherein each hydraulic means includes a hydraulic cylinder, a spring loaded piston means arranged in the cylinder, and the controlling means includes electromagnetic solenoid valve means for controlling a supply of pressure medium to the respective hydraulic means.

* * * * *